US008535111B2

(12) United States Patent
Wudtke

(10) Patent No.: US 8,535,111 B2
(45) Date of Patent: Sep. 17, 2013

(54) SPINNING TOY ACTION FIGURE

(71) Applicant: Karl Wudtke, Las Vegas, NV (US)

(72) Inventor: Karl Wudtke, Las Vegas, NV (US)

( * ) Notice: Subject to any disclaimer, the term of this patent is extended or adjusted under 35 U.S.C. 154(b) by 0 days.

(21) Appl. No.: 13/687,231

(22) Filed: Nov. 28, 2012

(65) Prior Publication Data

US 2013/0178131 A1 Jul. 11, 2013

Related U.S. Application Data

(60) Provisional application No. 61/585,560, filed on Jan. 11, 2012.

(51) Int. Cl.
*A63H 13/06* (2006.01)

(52) U.S. Cl.
USPC ..... 446/334; 446/330; 446/335; 446/354; 446/357

(58) Field of Classification Search
USPC ..... 446/236, 330, 334, 335, 354, 357
See application file for complete search history.

(56) References Cited

U.S. PATENT DOCUMENTS

| | | | | |
|---|---|---|---|---|
| 2,538,744 | A | 1/1951 | Berry | |
| 2,899,774 | A | 8/1959 | Mandel | |
| 3,684,291 | A * | 8/1972 | Johmann | 273/145 R |
| 3,705,726 | A * | 12/1972 | Johmann | 273/141 A |
| 4,095,368 | A | 6/1978 | Saito | |
| 4,209,938 | A | 7/1980 | Orenstein | |
| 4,579,543 | A | 4/1986 | Renger et al. | |
| 4,738,649 | A | 4/1988 | Delli Bovi et al. | |
| 5,087,219 | A * | 2/1992 | Price | 446/336 |
| 5,458,523 | A | 10/1995 | Aoki et al. | |
| 8,057,275 | B2 | 11/2011 | Cameron et al. | |
| 8,057,276 | B2 | 11/2011 | O'Connor | |

FOREIGN PATENT DOCUMENTS

JP 06327843 A 11/1994

* cited by examiner

*Primary Examiner* — John Ricci
(74) *Attorney, Agent, or Firm* — Patent Law Offices of Michael E. Woods; Michael E. Woods

(57) ABSTRACT

An apparatus that includes a core body, a rotational spring motor and several flexible limbs. One of the flexible limbs is the, "the drive arm" and connects to the motor inside the body. The drive arm has a connection point at the other end (hand) that allows it to connect to other like toys.

8 Claims, 18 Drawing Sheets

SPINNING TOY ACTION FIGURE

CROSS REFERENCE TO RELATED APPLICATIONS

This application claims benefit of U.S. Patent Application No. 61/585,560 filed 11 Jan. 2012, the contents of which are hereby expressly incorporated by reference thereto in its entirety for all purposes.

FIELD OF THE INVENTION

The present invention relates generally to motorized action toys, and more specifically, but not exclusively, to spinning engageable action figures simulating engaged hand-to-hand combat.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Boxing simulators (or other gameplay devices simulating punching or striking of an opponent) are well-known in the art. These simulators typically include two simulated separated combatants that are faced off against each. Some mechanism is often employed in which an appendage (typically a fist for example) of one or both of the simulated combatants is motivated in order to attempt to strike the other combatant. Various systems are used in order to gauge the effectiveness or other metric of these attempts.

Simulated physical interactions between action figures are popular with children of all ages. However, repeated implemented of similar themes can reduce the enjoyability, and popularity, of such toys. It is desirable to find ways to vary the nature and types of interactions available in a children's action toy to maintain interest and continue to develop inquisitiveness and enjoyment.

What is needed is an apparatus and method for simulating non-boxing physical interactions for action figures.

BRIEF SUMMARY OF THE INVENTION

Disclosed is an apparatus and method for simulating non-boxing physical interactions for action figures. The present invention includes embodiments directed towards skirmishes with two or more combatants are engaged and simulate hand-to-hand combat, such as wrestling or other fighting format.

The following summary of the invention is provided to facilitate an understanding of some of technical features related to mechanically simulated hand-to-hand combat, and is not intended to be a full description of the present invention. A full appreciation of the various aspects of the invention can be gained by taking the entire specification, claims, drawings, and abstract as a whole. The present invention is applicable to other toy categories besides mechanically simulated combat, as well as extended to support structures and accessories supporting and enhancing the action sequences, and applicable to engagement of more than two skirmishers, and the skirmishers need not be humanoid.

Some embodiments of the present invention provide a wind up figurine simulating fighting sequences with energy and realism. Features include application of an extra strong spring motor powering an unconstrained (by motor control) rotation of one of the limbs of the figurine, and incorporation in the design of round and rounded body shapes and elimination of rotation/spin inhibiting elements to enhance the spinning action imparted during gameplay. When coupled to another figurine during the random gameplay sequences, the shape of the body allows the figurine to spin without significant drag or interference from its contact point on a playsurface. In addition, the limbs connected to the body are articulated and will fold away from obstacles in order to limit hang-ups or other rotation/spin inhibition.

An apparatus, including an action figure including a body having a cavity, a motor disposed within the cavity, and a plurality of flexible limbs coupled to the body that may be articulated, and held, into a desired pose wherein the motor is responsive to an actuation to power a rotation of a drive; an elongate drive element, having a proximal end coupled to the drive and a longitudinal axis extending along a length of the drive element, the drive element configured to rotate around the longitudinal axis in response to the rotation of the drive wherein the drive element is configured as an appendage of the action figure, the appendage including one of an arm, a leg, a hand, a foot, a head, a tail, or portions thereof; and one of a type 1 coupler or a type 2 coupler as a drive element coupler, the type 1 coupler and the type 2 coupler complementary to each other, the drive element coupler disposed at a distal end of the drive element.

A method including a) actuating selectively a motor disposed inside an action figure having articulatable limbs coupled to a body, the selective actuation of the motor producing a rotation of a drive element; b) transferring the rotation of the drive element to a longitudinal rotation through an appendage of the action figure, the appendage having a proximal end coupled o the body and a distal end coupled to a longitudinally rotating drive element coupler; and c) rotating longitudinally the drive element coupler whenever the motor is actuated.

An apparatus with a first skirmisher including a body having a cavity, a motor disposed within the cavity, and a plurality of flexible limbs coupled to the body that may be articulated, and held, into a desired pose wherein the motor is responsive to an actuation to power an ungoverned rotation of a drive; an elongate drive element, having a proximal end coupled to the drive and a longitudinal axis extending along a length of the drive element, the drive element configured to rotate around the longitudinal axis in response to the rotation of the drive; and one of a type 1 coupler or a type 2 coupler as a drive element coupler, the type 1 coupler and the type 2 coupler complementary to each other, the drive element coupler rotationally disposed at a distal end of the drive element, the drive element coupler rotating about a pivot axis perpendicular to the longitudinal axis.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Embodiments of the present invention provide an apparatus and method for simulating non-boxing physical interactions for action figures. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
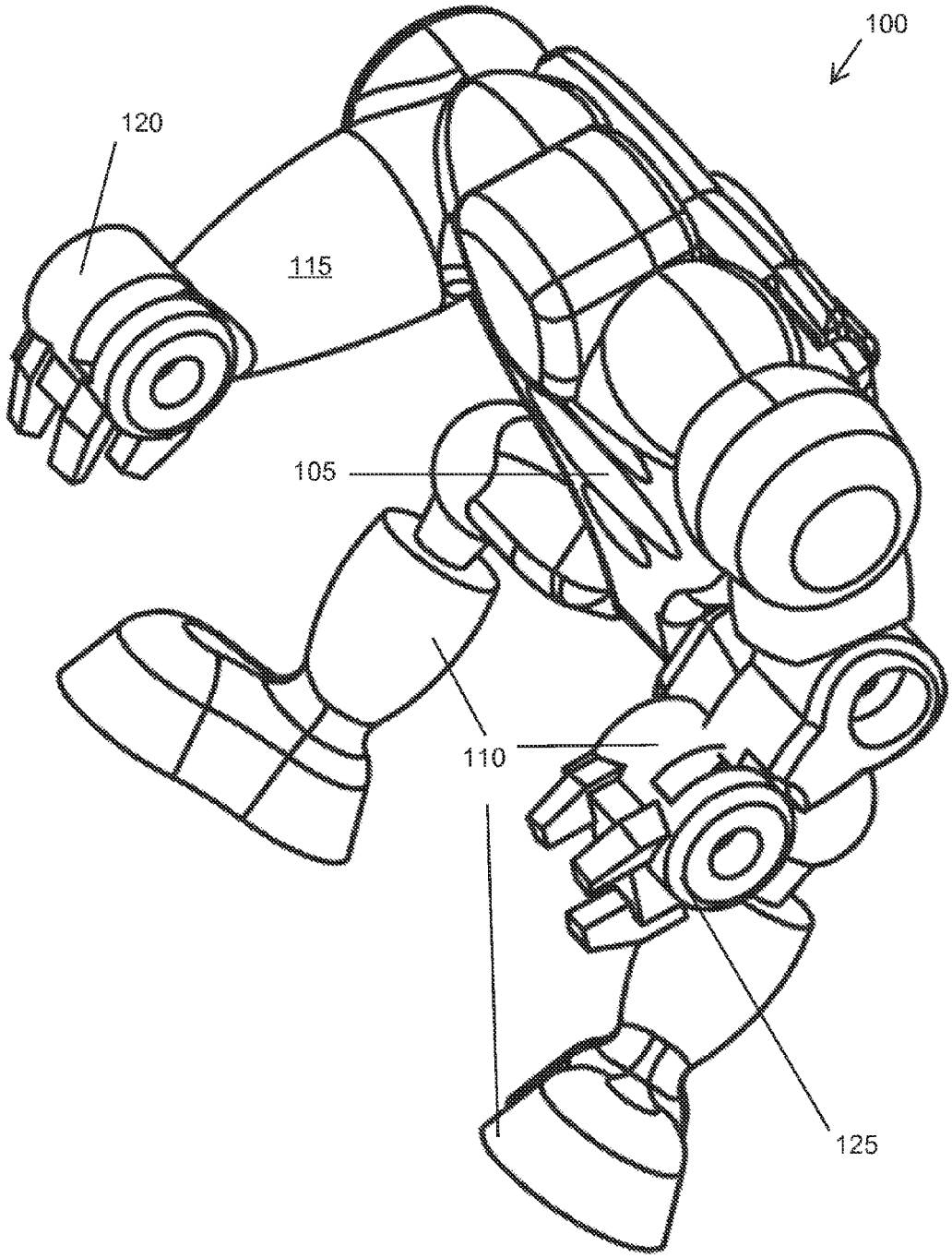
FIG. 1 illustrates a perspective view of an action figure.
Figure 3:
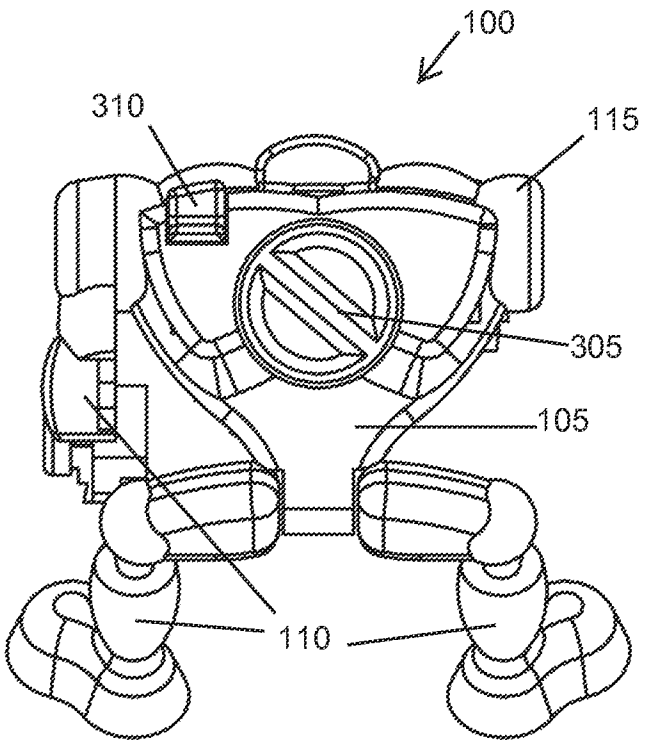
FIG. 3 illustrates a back view of the action figure.
Figure 2:
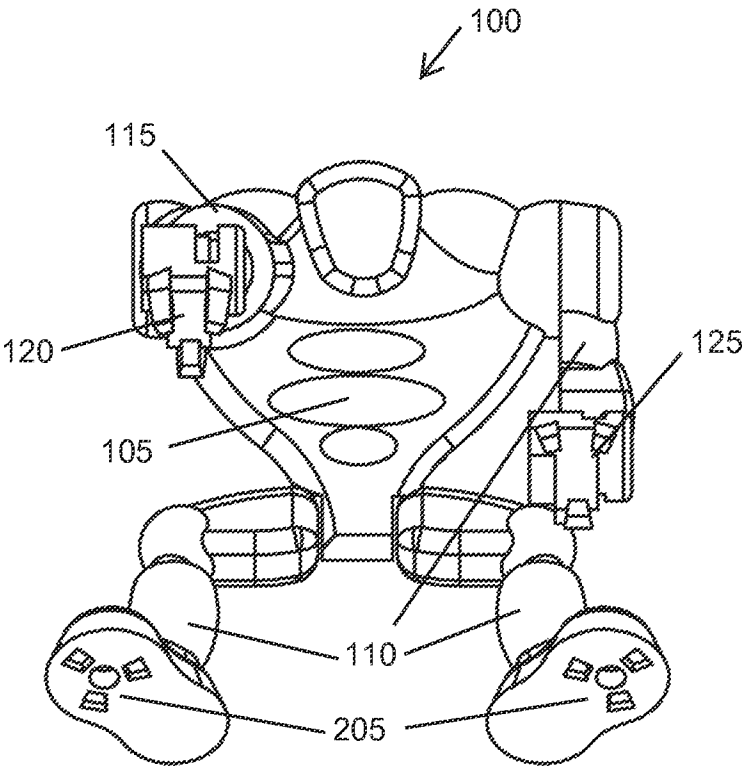
FIG. 2 illustrates a front view of the action figure.
Figure 4:
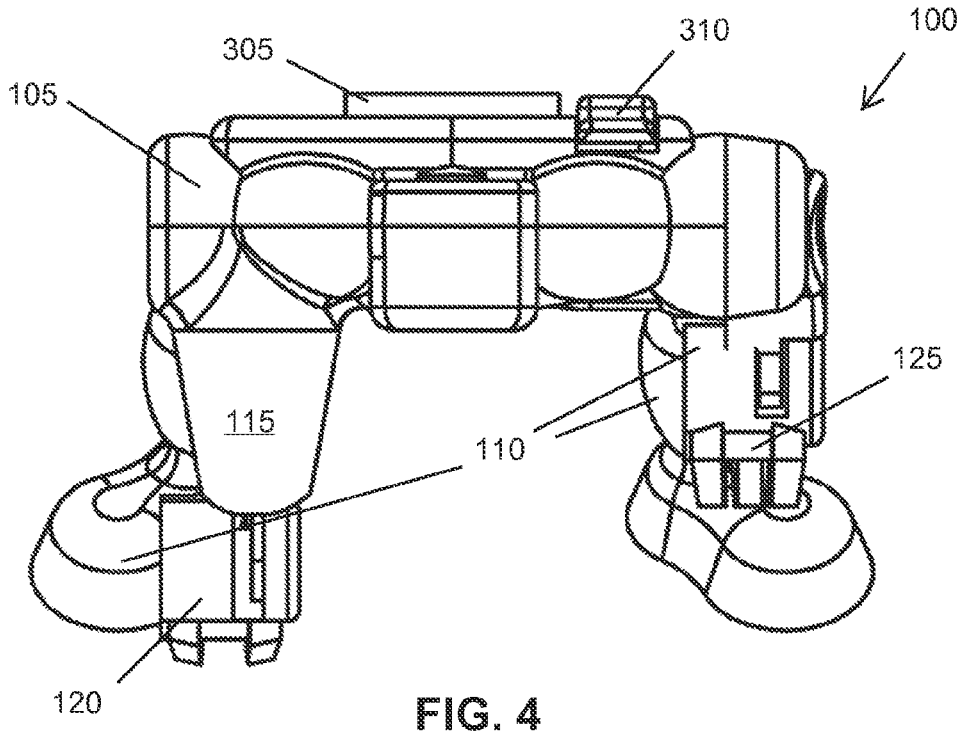
FIG. 4 illustrates a top view of the action figure.
Figure 5:
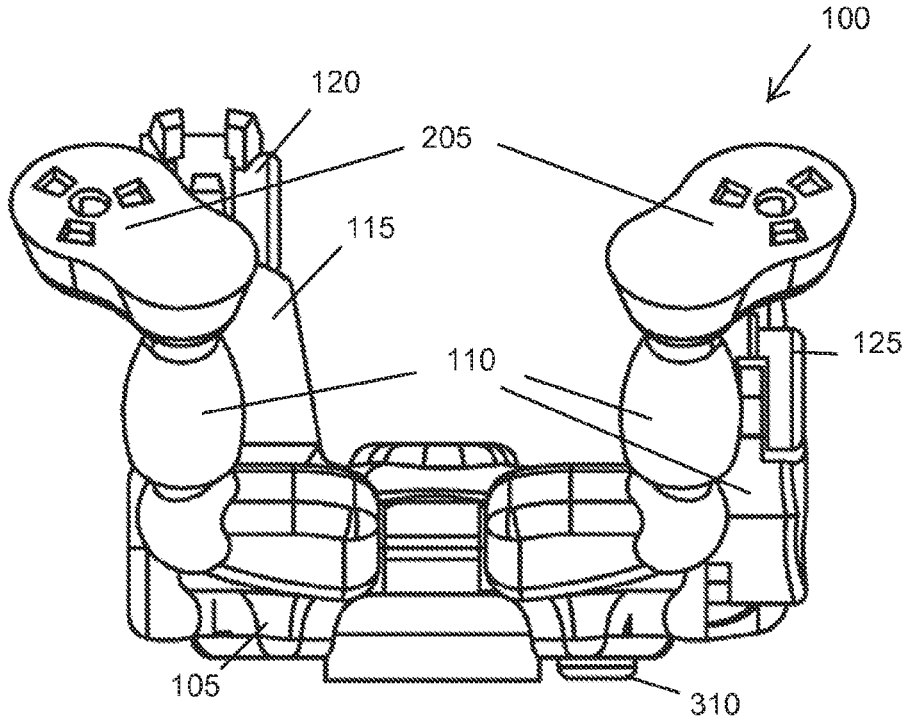
FIG. 5 illustrates a bottom view of the action figure.

FIG. 1-FIG. 5 illustrate an action figure. FIG. 1 illustrates a perspective view of an action figure 100; FIG. 2 illustrates a front view of action figure 100; FIG. 3 illustrates a back view of action figure 100; FIG. 4 illustrates a top view of action figure 100; and FIG. 5 illustrates a bottom view of action figure 100. Action figure 100 includes a body 105, a motor and several articulated limbs 110. One flexible limb 110 is a drive limb 115 and connects to the motor inside body 105. Action figure 100 employs a universal coupling system that includes a type 1 coupler and a complementary engageable type 2 coupler. For embodiments that are not implemented in an action figure, there may not be "limbs" and as such the drive limb may be a drive appendage or other drive structure.

In a preferred embodiment, the universal coupling system includes quick-connect couplers that may be easily joined together, yet sufficiently powerful to resist unintended decoupling during the gameplay described herein. For example, a type 1 coupler may be a "male" connector including one or more bayonet-type elements and an optional integrated magnetic element. A type 2 coupler may be a "female" connector including a number of receptacle-type elements corresponding to the number of bayonet-type elements of the type 1 coupler. Additionally, a magnetically-active material (e.g., iron plate, magnet with complementary magnetic pole, or the like) may be integrated into the type 2 coupler. Engagement of the type 1 coupler and the type 2 coupler thus provides a physical bond (e.g., the physical engagement of the bayonet/receptacle elements AND any the magnetic attractive force) that allows quick assembly that resists unintended decoupling during gameplay. Of course other types of connectors and engagement systems may be employed without departing from the present invention (e.g., non-magnetic couplers including friction fit, snap fit, mechanical interlock, and the like). One advantage of the described universal coupling system is that the physical bond not only resists decoupling, it also resists any relative longitudinal rotation at the point of engagement between the type 1 coupler and the type 2 coupler. In this sense, longitudinal rotation is rotation about a longitudinal axis extending from a drive limb to a device coupled to the drive limb. Preferably there is no longitudinal slip or appreciable hysteresis to dissipate energy from the drive motor.

Action figure 100 includes a number of engagement points supporting different types of couplers. As further described below, the gameplay includes simulated non-boxing physical activity between two or more action figures 100. One embodiment provides that one of these action figures 100 is a driving action figure and the other action figures 100 are reaction action figures, responding to the driving action figure. In one implementation, each action figure 100 is fungible and able to serve in both the driving role and in the reaction role. In other embodiments, there are different variations of action figure 100, some that are specifically designed for the driving role and some are specifically designed for the reaction role. Differences between these roles include action figures 100 designed for the driving role requires the motor and drive limb 115. Action figures 100 designed for the reaction role do not necessarily require the motor and/or drive limb 115. Another potential difference between action figures 100 in different roles is the nature and arrangement of engagement points (preferred embodiments for action figure 100 in the drive role need define a single engagement point while reaction role action figures 100 may support multiple engagement points). For example, an end of drive limb 115 may be defined as an engagement point and configured with a type 1 coupler 120.

Any action figure 100 that is to include a reaction role is configured with at least one engagement point supporting a type 2 coupler 125. For fungible action figures 100, engagement points and coupler types are advantageously defined to be minor images. For example, drive limb 115 is shown supported at a "right" arm with a type 1 coupler, thus the minor image implementation provides a left arm defined with an engagement point supporting a type 2 coupler. In this way, when two action figures face each other, action figure 100 in the drive role is able to engage the type 1 coupler of drive limb 115 with the type 2 coupler of action figure 100 in a reaction mode. This is true whichever action figure 100 is in which role. Other embodiments of the present invention provide additional engagement points on body 105 and/or various flexible limbs 110. Other attachment points may define other types of complementary type 2 connectors. FIG. 2 includes an alternative type 2 coupler 205. Alternative type 2 couplers may be disposed on other action figures or on various pieces of equipment disposed in the environment of a play event.

In some embodiments, multiple action figures 100 in a skirmish may all independently employ the drive role. In other embodiments, action figure 100 may also interface to some other type of toy or structure other than action figure 100. There may be props or compatible toys that employ connectors of the universal coupling system to enable interaction with action figure 100. Some of these props and compatible toys may include a drive limb 115 and/or a type 2 coupler 125/205.

The motor used in action figure 100 may be of many different types, including a spring-powered motor, a battery-powered electric motor, and the like. In FIG. 3, a winder 305 is shown as one way for a user to interact with a spring-powered motor. The user rotates winder 305 to add energy into the spring-powered motor, which may then be used by drive limb 115 to implement the gameplay. In some embodiments, a winding key or other interaction mechanism may be used to wind or otherwise add energy into the motor, as appropriate. Some embodiments provide that that winder 305 is incorporated into a component of action figure 100 (e.g., the user twists an arm, leg, waist, head, or the like). Additionally, a release switch 310 for the motor is shown. Release switch 310 enables the user to actuate action figure 100 and release stored energy in the motor to power drive limb 115. After energizing the motor, and configuring the skirmish by engaging action figures 100 and defining roles, the user actuates release switch 310 to begin the simulated physical activity.

In the embodiments illustrated herein, the motor is designed to release its energy relatively unconstrained by a motor speed control over a sustained period of time to maintain interest in the simulated physical activity. Some embodiments may employ a speed governor to slow the simulated physical activity imparted by the motor.

Figure 6:
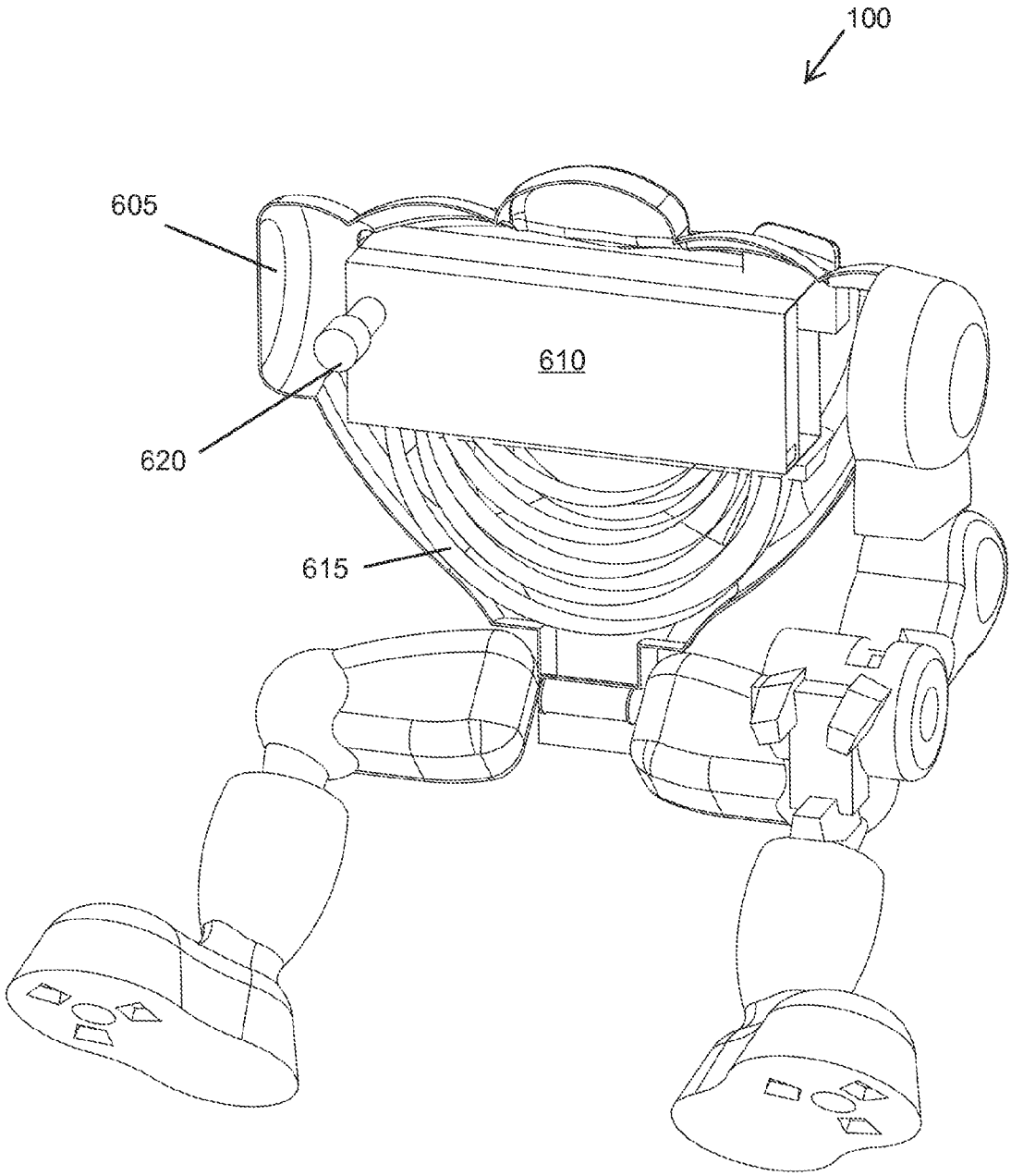
FIG. 6 illustrates the action figure with a front housing removed.

FIG. 6 illustrates action figure 100 with a front housing of body 105 removed to reveal an interior cavity within a back housing 605. The interior cavity supports a motor 610 (e.g., a spring-powered motor with a spring 615) driving a power take-off 620 (e.g., a powered driveshaft or the like) coupled to drive limb 115. Depending upon a configuration and arrangement of motor 610, there are appropriate ways to energize, and release energy, in order to selectively operate action figure 100.

Figure 7:
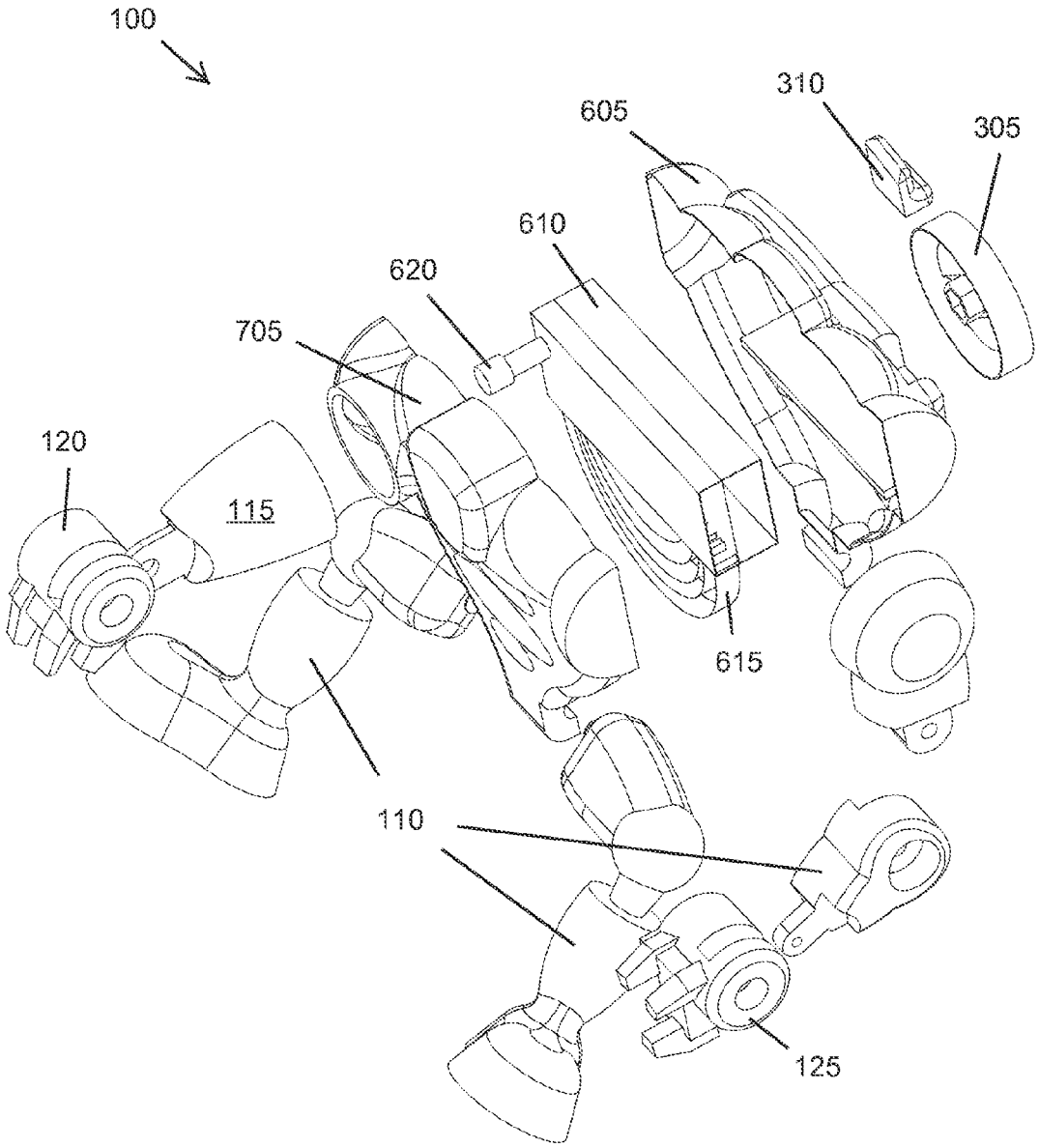
FIG. 7 illustrates an exploded view of the action figure.

FIG. 7 illustrates an exploded view of the action figure 100, including a front housing 705 that mates with back housing 605 and contains motor 610. As shown, limbs 110 are moveably coupled to body 105 and include articulable/bendable elements to provide a desired action during gameplay.

Figure 8:
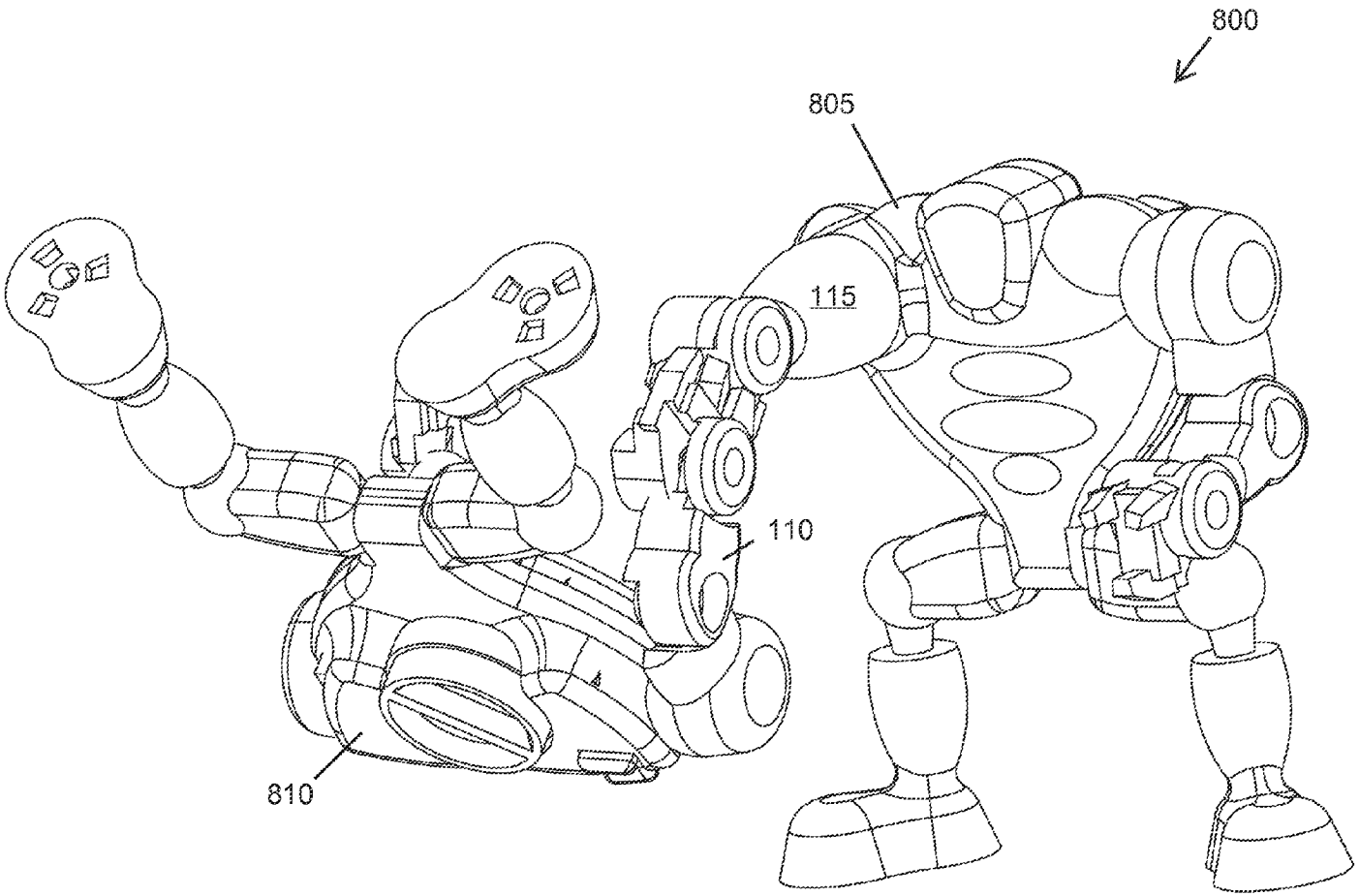
FIG. 8 illustrates a snapshot of gameplay action between a pair of engaged action figures.

FIG. 8 illustrates a snapshot of a skirmish 800 between a pair of engaged action figures, e.g., a driving action figure 805 and a reaction action figure 810. One way that skirmish 800 proceeds is for the user to energize driving action figure 805, such as by winding a spring-powered motor. The user is preferably able to arbitrarily set a desired power level by the amount of energy imparted during winding. Driving action figure 805 is engaged with reaction action figure 810 by attaching drive limb 115 of driving action figure 805 to an "arm" of flexible limb 110 of reaction action figure 810. Engagement is achieved by using, for example, a type 1 coupler of drive limb 115 engaged with a type 2 coupler on engaged flexible limb 110. And then the action figures are positioned in preparation for the skirmish—such as having the action figures sit facing each other on a playsurface, or other desired configuration. Other embodiments include coupling a plurality of action figures, one or more of which include driving action figures, together, activating the one or more driving action figures, and tossing them in to battle.

When ready, the user presses release switch 310 of driving action figure 805 which rotationally powers drive limb 115 to impart a relative rotational force to reaction action figure 810 using the stored energy of the motor. By imparting a sufficiently large relative rotational force, one or both of the action figures begin to rotate relative to each other and any obstacles or structures on the playsurface. The action figures rotate, countering each other, and can begin to spin freely on the playsurface, sometimes with one or the other "on top" of the other or having some other predetermined orientation, and sometimes quite vigorously for certain designs and energy levels of the motor. As long as energy is being dissipated from the motor to power drive limb 115, the action figures simulate non-boxing physical interactions of wrestling, fighting, thrashing, combat, or the like. At some point, insufficient energy will be available in the motor to change the relative positions of the action figures. Depending upon the nature of the gameplay, an action figure that finishes "on top" or in the predetermined orientation may be declared the winner. The user is then able to repeat the process as desired.

In a preferred embodiment, drive limb 115 is generally elongate with a longitudinal axis extending from a proximal end to a distal end. The proximal end is coupled to the body and has an internal drive engagement with the motor. The distal end is provided with a drive element coupler that is one of a type 1 or a type coupler from the universal coupling system. The drive element coupler rotates about the longitudinal axis responsive to the motor and the internal drive engagement. There is an external covering or housing concealing and protecting the internal drive mechanism joining the motor to the drive element coupler.

The preceding includes a discussion of action figures, their construction, and operation in general for simulation of mechanically simulated action sequences. In the context of interactive gameplay, there are additional structures and elements that enhance and extend the basic gameplay described above. These additional structures and elements include arenas to focus the simulated action and to simulate a real-world activity with more realism as well as environmental features for interaction and simulated context and added excitement. Further, disclosed are structures and elements that are triggered or operable by the power take-off to add additional play options for the user.

Figure 9:
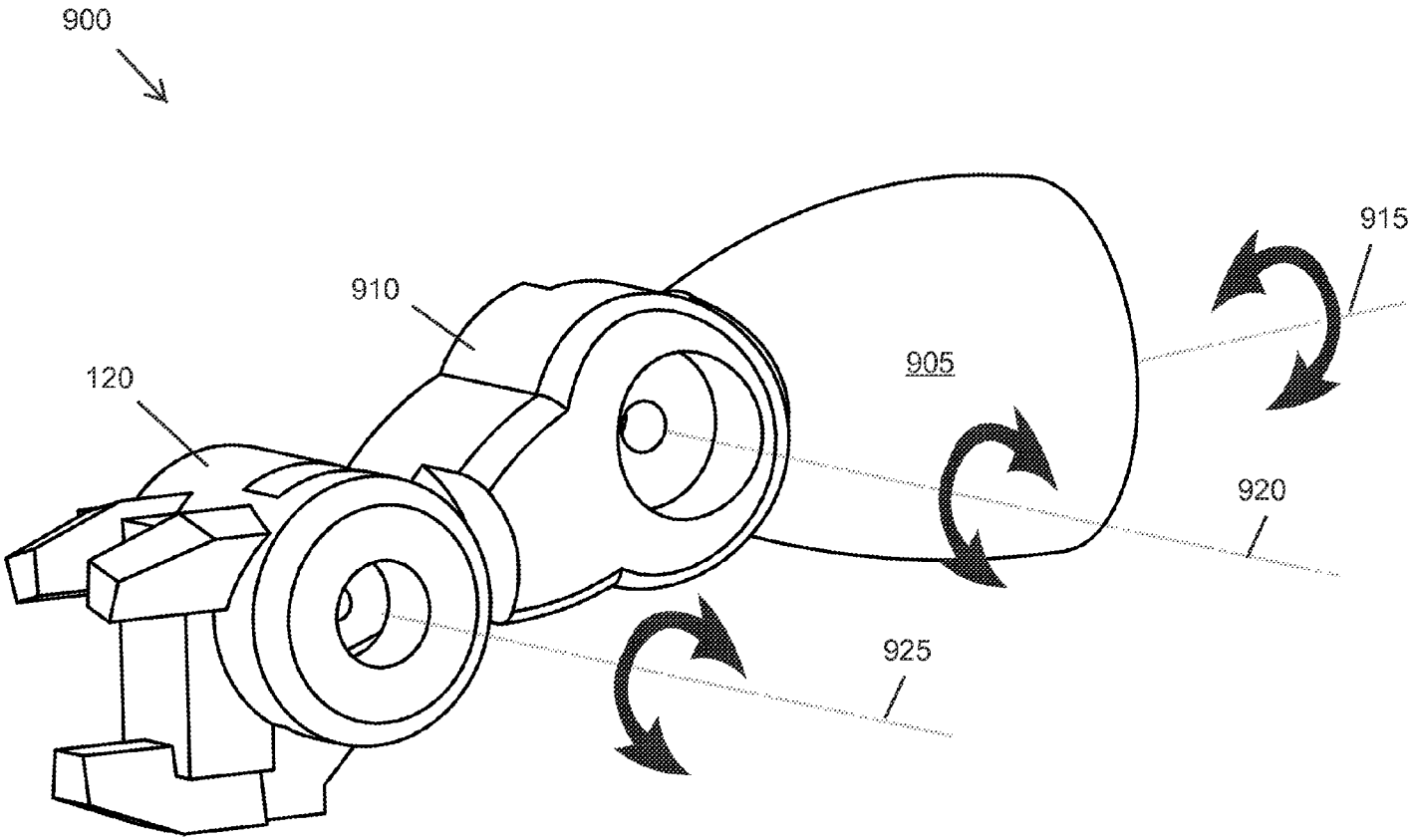
FIG. 9 illustrates an alternate articulated drive limb.

FIG. 9 illustrates an alternate drive limb 900 to that shown and described in FIG. 1, with these limbs being substitutable for each other. Drive limb 900 includes a rigid member 905 that is connected, directly or indirectly, to motor 610. Drive limb 900 includes coupler 120 and one or more optional intermediate drive limb extenders 910. Rigid member 905 is "rigid" in the torsional/rotational sense. Rigid member 905 includes a longitudinal axis 915 about which motor 610 rotates drive limb 900. Coupler 120 and drive limb extenders 910 are each rotationally coupled to rigid member 905 about a pivot axis that is preferably perpendicular to longitudinal axis 915. Limb extender 910 has a first pivot axis 920 that is illustrated as perpendicular to longitudinal axis 915. Coupler 120 has a second pivot axis 925 that is illustrated as perpendicular to longitudinal axis 915. It is not required that first pivot axis 920 and second pivot axis 925 point in the same direction (e.g., second pivot axis 925 could be perpendicular to both longitudinal axis 915 and first pivot axis 920). It is preferred for the pivot axes to be perpendicular to longitudinal axis 915 to not lose torque when transferring energy from motor 610 through drive limb 900. In this regard drive limb 900 and drive limb 115 are the same in that coupler elements have no appreciable torsional hysteresis or slip to dissipate drive energy when transferring drive torque between motor 610 and any structure coupled to coupler 120.

Figure 10:
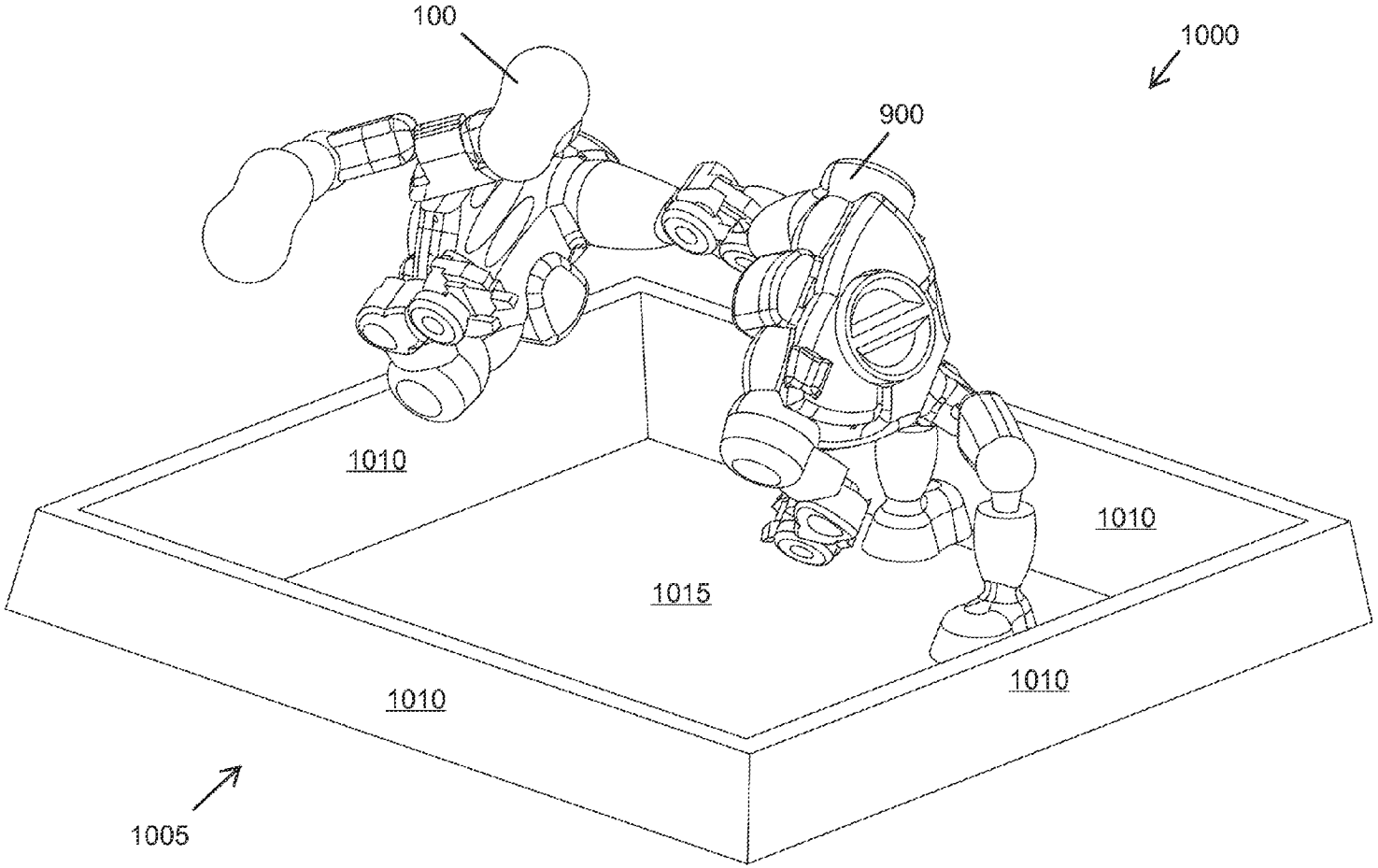
FIG. 10 illustrates a "sandbox" arena supporting action sequences by engaged action figures.

FIG. 10 illustrates a "sandbox" arena 1000 supporting action sequences by engaged action figures (e.g., action figure 100 and/or action figure 900). Sandbox arena 1000 includes a walled enclosure 1005 for limiting the simulated action sequences by physically constraining the action figures. This and the other "arena" implementations are variations on a defined playsurface for the simulated action sequences. Walled enclosure 1005 includes a set of short vertically extending walls 1010 around a closed perimeter. The perimeter may be a more conventional "square" athletic ring or may have other perimeter shapes. Walls 1010 need only be high enough to constrain the action figure simulated combat sequences inside walls 1010. Some embodiments include an optional mat (or floor) 1015 coupled to walls 1010 which helps to ensure that walled enclosure 1005 does not move in response to the action figures contacting walls 1010.

Figure 11:
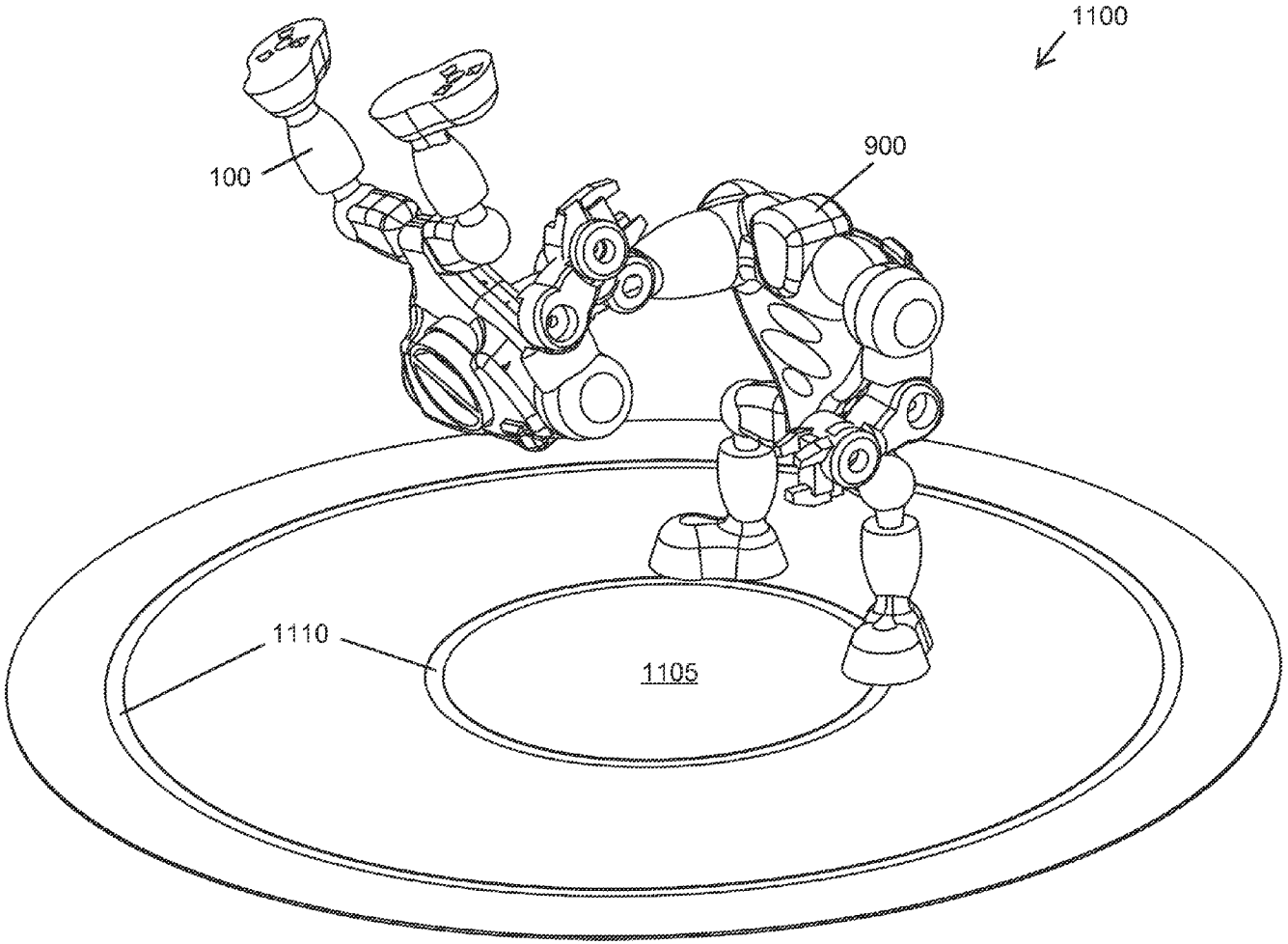
FIG. 11 illustrates a circular pad arena supporting action sequences by engaged action figures.

FIG. 11 illustrates a circular pad arena 1100 supporting action sequences by engaged action figures (e.g., action figure 100 and/or action figure 900). Circular pad arena 1100 includes a circular playsurface 1105 that includes one or more circular rings 1110 identifying/demarking key locations for the game play action. Circular pad arena is representative/suggestive of Sumo and Romo-Grecian style combat venues wherein a participant passing an out-of-bounds marker loses a round. Circular rings 1110 may serve that purpose for some animated combat sequences. Other rule systems may be used in addition to or in lieu of the ones disclosed herein.

Figure 12:
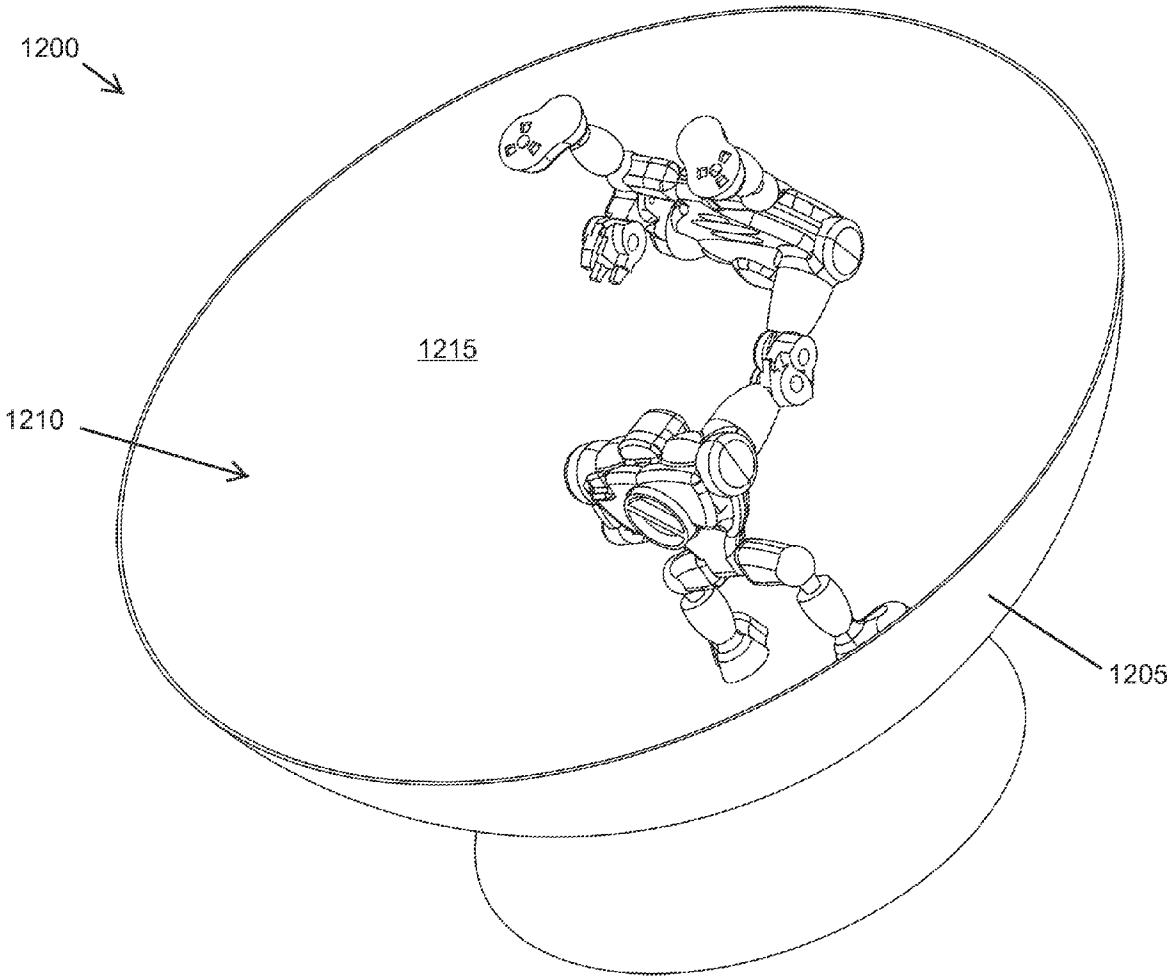
FIG. 12 illustrates a bowl arena supporting action sequences by engaged action figures.

FIG. 12 illustrates a bowl arena 1200 supporting action sequences by engaged action figures. Bowl arena 1200 includes a body 1205 defining a cavity 1210 having curved inner surface 1215. Inner surface 1215 may a portion a sphere, ellipsoid, or other curved surface. Bowl arena 1200 has an advantage of re-focusing the simulated combat sequences back towards the center or centerline as the contours of inner surface 1215 biases the combat sequence.

Figure 13:
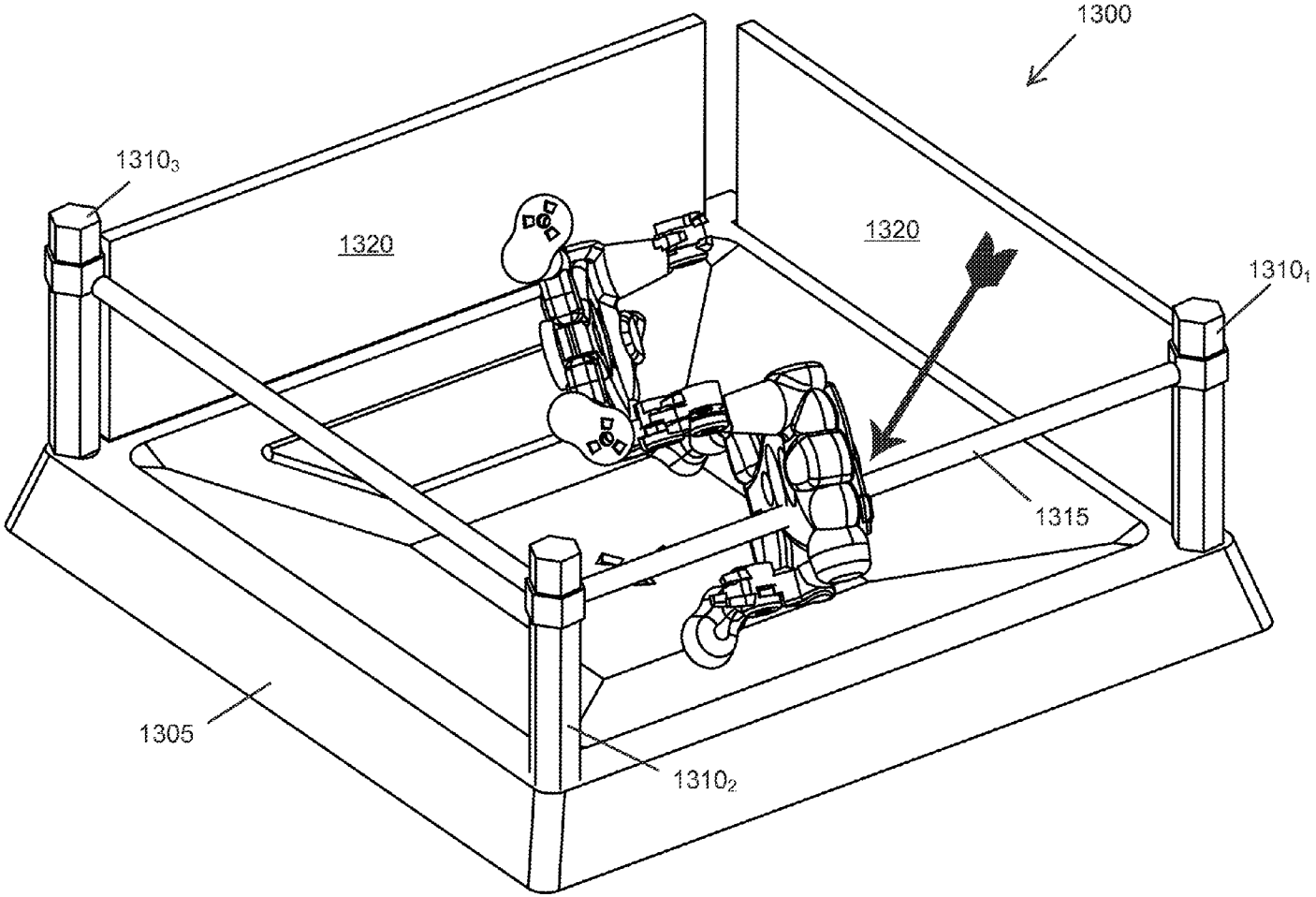
FIG. 13 illustrates an interactive athletic ring arena supporting action sequences by engaged action figures.

FIG. 13 illustrates an interactive athletic ring arena 1300 supporting action sequences by engaged action figures. Interactive athletic ring arena 1300 may be similar to sandbox arena 1000 or adopt features from the other disclosed arena formats. For example, interactive athletic ring arena 1300 includes a walled enclosure with sloped walls/floor 1305. Additionally, optional arena posts 1310 at one or more vertices of the enclosure perimeter may define interactive elements. For example, between arena poles (e.g., a first arena pole $\mathbf{1310}_1$ and a second arena pole $\mathbf{1310}_2$), a beam 1315 (e.g., an IR beam) or other optic circuit is generated. Should an action figure or element interrupt the IR beam, a reaction is triggered. Those reactions may include an electronic reaction such as a sound, an initiation of an action with an actuator, motor, or the like. In other implementations, includes the electronic beams along one or more perimeter segments and solid walls 1320 along one or more other perimeter segments. Walls 1320 may respond to the triggering from the interrupted electronic beam by unlocking to pivot away or slide down into the floor. Game play could include a round loss for the first action figure leaving the arena and the triggering of the electronic beam increases the chances of an action figure leaving the arena by dropping one or more solid walls 1320.

Figure 14:
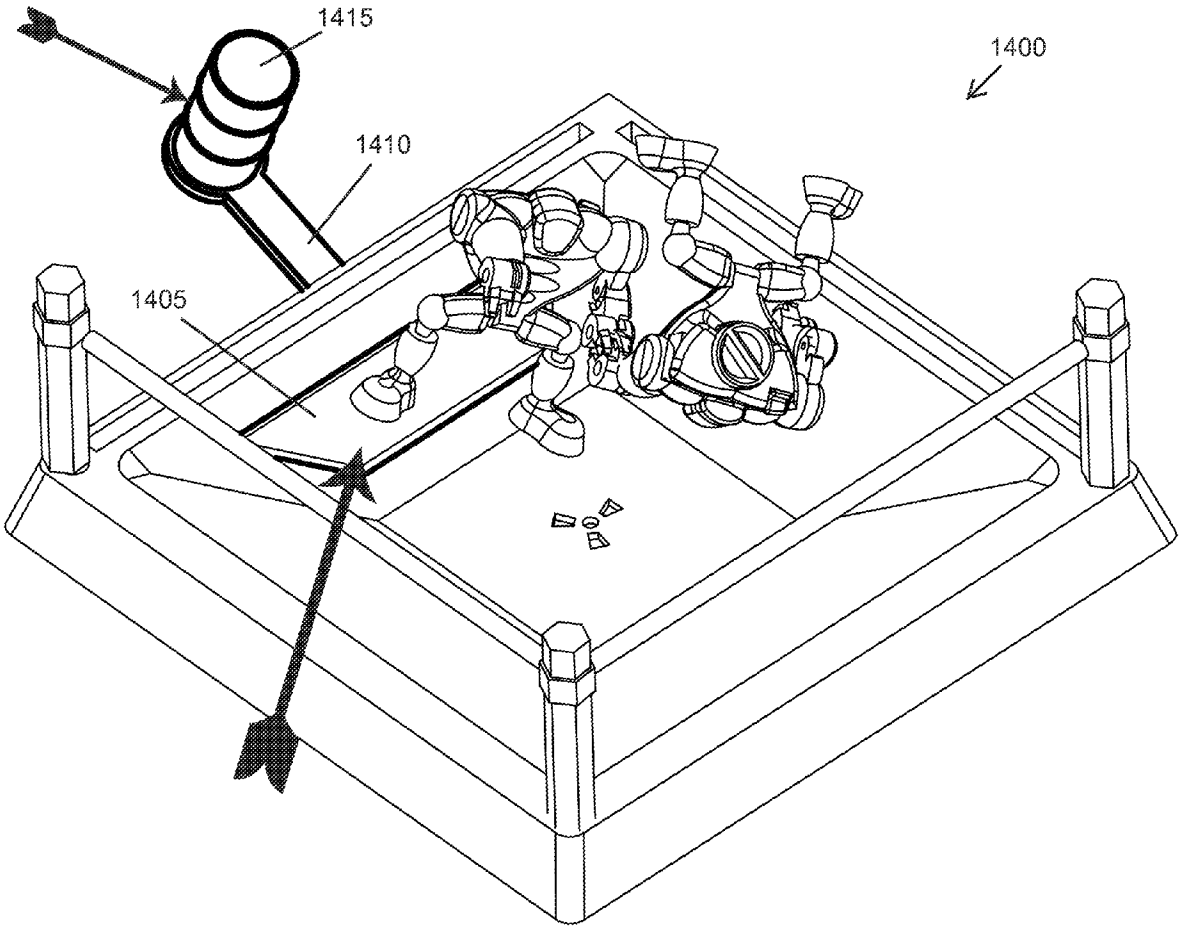
FIG. 14 illustrates an alternative interactive athletic ring arena supporting action sequences by engaged action figures.

FIG. 14 illustrates an alternative interactive athletic ring arena 1400 supporting action sequences by engaged action figures. Interactivity may be added not only by perimeter beams or by moving walls. In arena 1400, a component of the playsurface, which may be a floor, sidewall or the like, is provided with a contact switch 1405 or other sensor. In the event that an action figure engages contact switch 1405, a secondary event is triggered in response. The secondary event may include a release of a spring loaded door, object, or the like or an actuation of a motor or other action, and/or initiation of an audiovisual event. For example, actuating contact switch 1405 initiates a spring-loaded arm 1410 to swing up and deposit an object 1415 onto the playsurface. Other actions or combinations of actions may be triggered in response to actuation of contact switch 1405.

Figure 15:
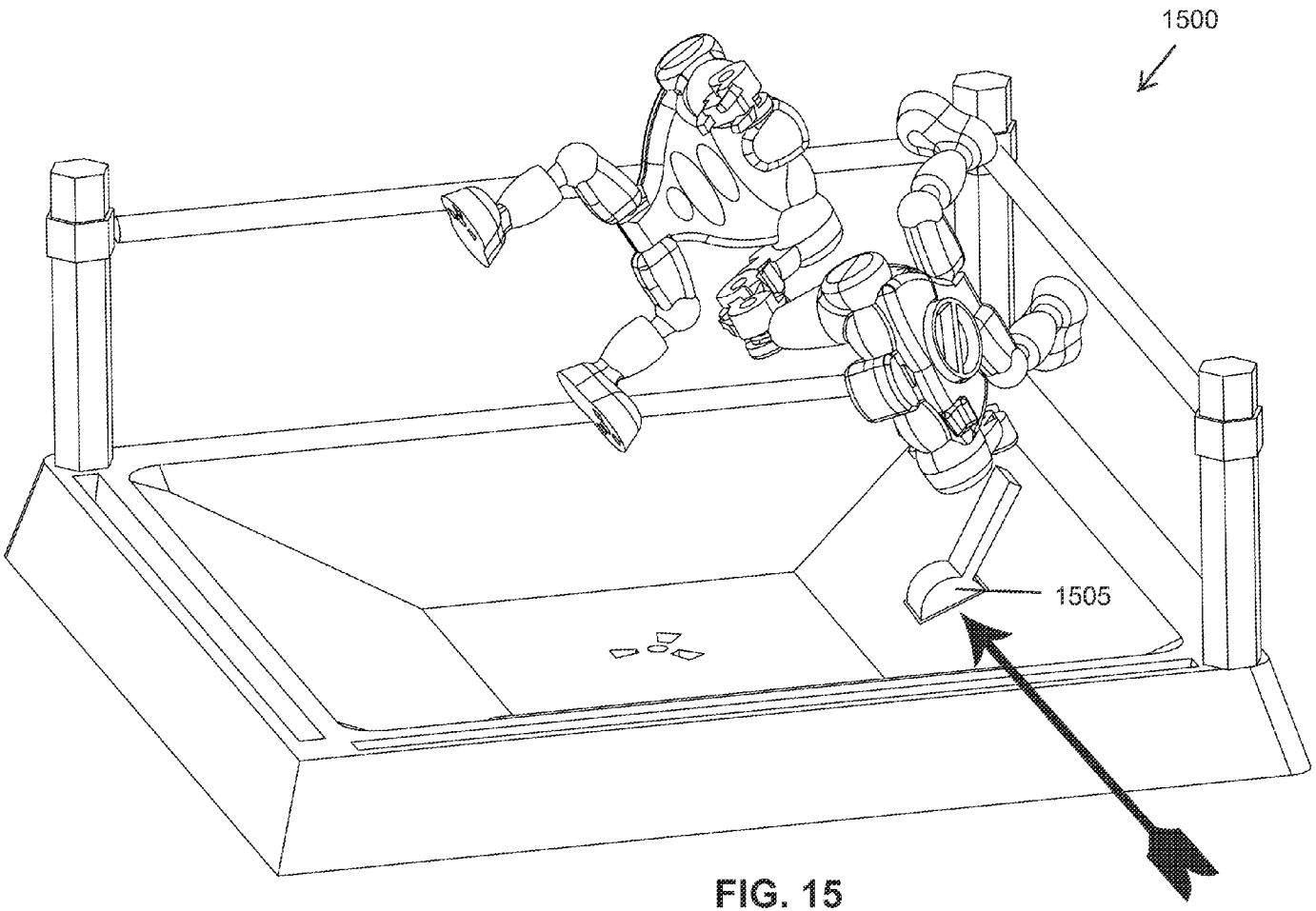
FIG. 15 illustrates another alternative interactive athletic ring arena supporting action sequences by engaged action figures.

FIG. 15 illustrates another alternative interactive athletic ring arena 1500 supporting action sequences by engaged action figures. While similar to alternative interactive athletic ring arena 1400, alternative interactive athletic ring arena 1500 includes an actuating lever 1505 rather than contact switch 1405. Depending upon implementation, it may be "rarer" to trip actuating lever 1505 than contacting contact switch 1405. In other respects, responses to the tripping actuating lever 1505 are similar to contacting contact switch 1405. Of course some arena may be provided with both switch(es) and lever(s) for different types of responses.

Figure 16:
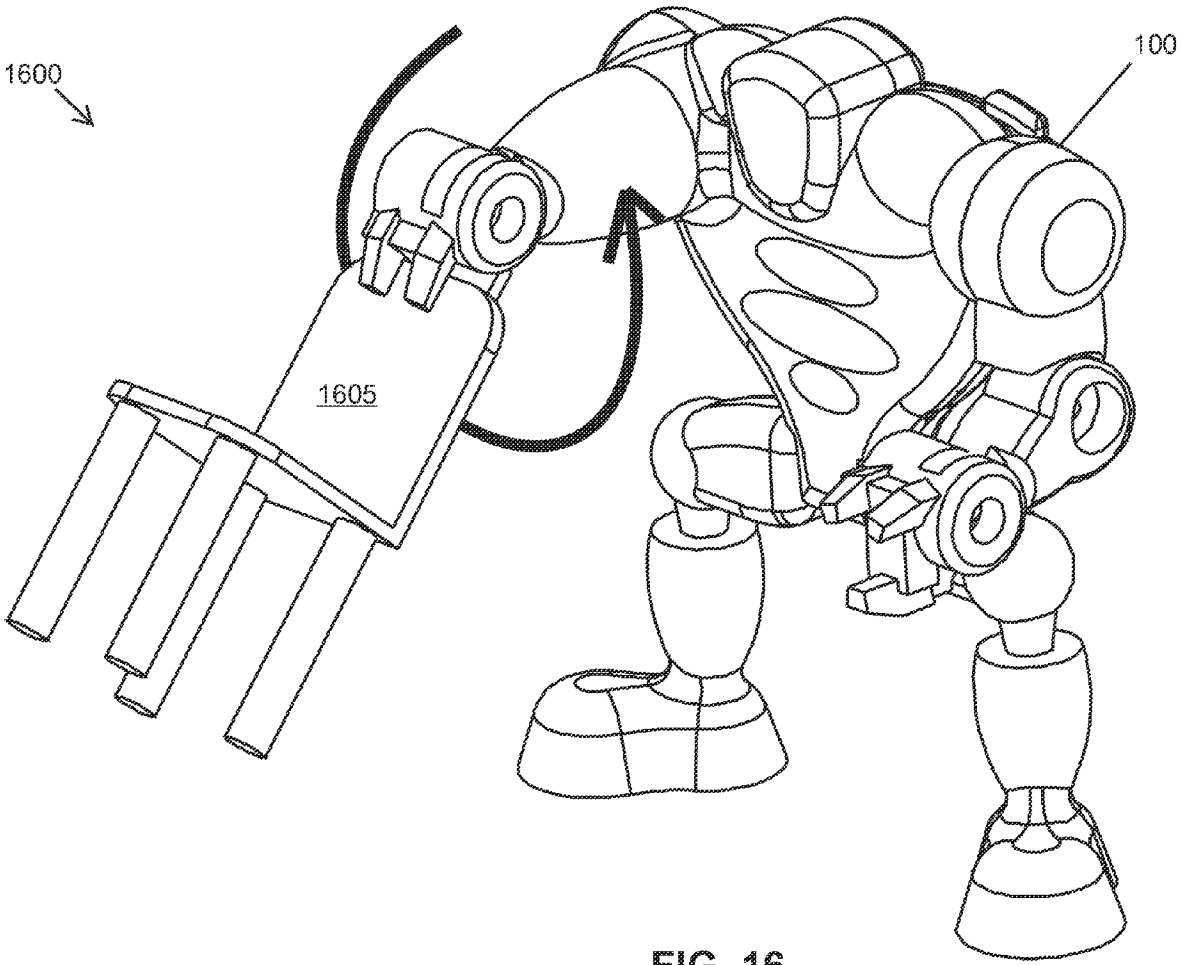
FIG. 16 illustrates environmental manipulation by the power take-off of an action figure.

FIG. 16 illustrates a play environment 1600 with environmental manipulation by the power take-off of action figure 100. Environmental manipulation includes coupling to an object 1605 (e.g., environmental elements/props) or other environmental object such as, for example, a chair, table, ladder, rope, pole, weapon, or the like. The power take-off will cause the coupled object to spin when action figure 100 is actuated.

Figure 17:
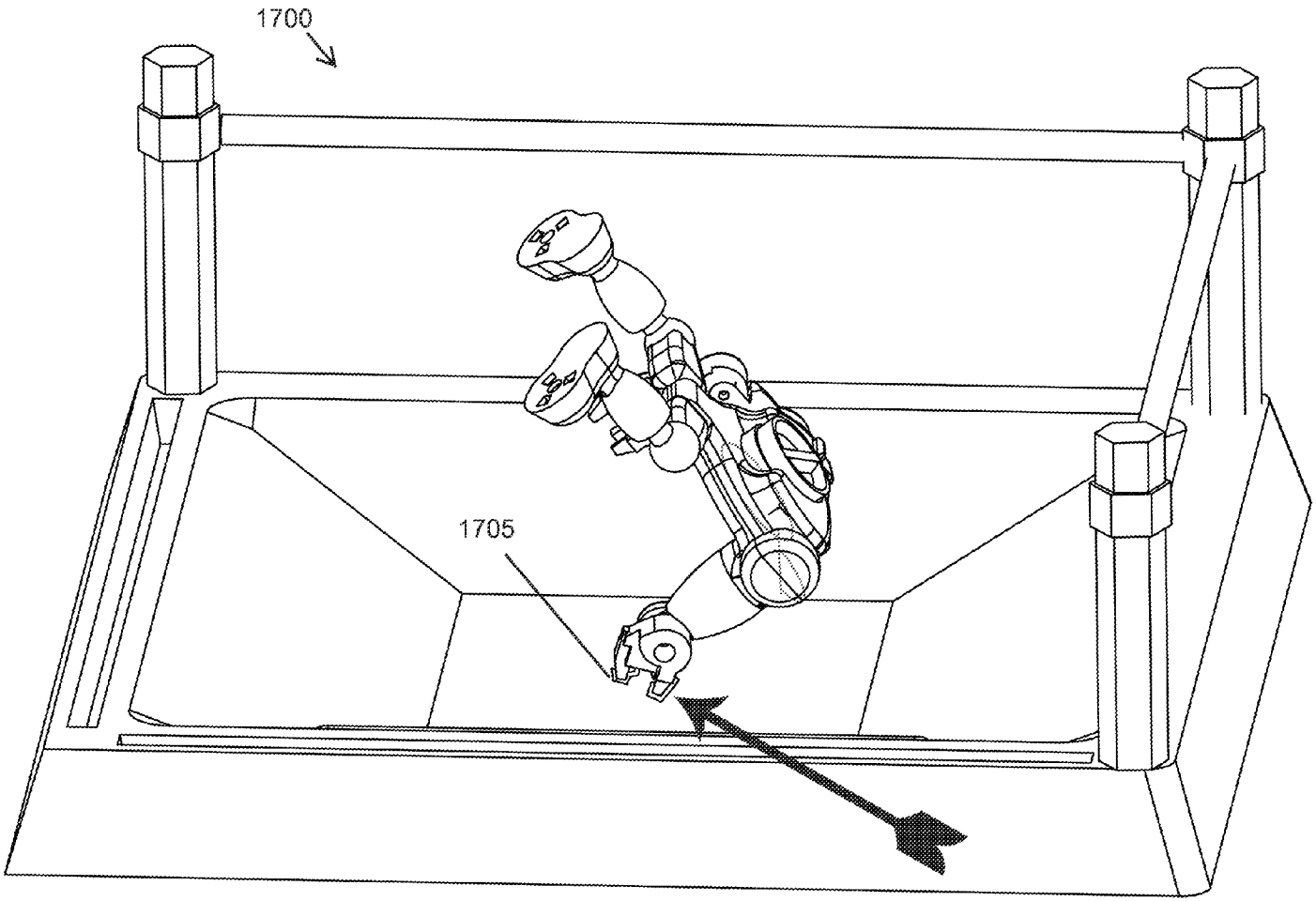
FIG. 17 illustrates an alternative arena enhancement feature for use with the arenas described herein.

FIG. 17 illustrates an arena system 1700 including an alternative arena enhancement feature 1705 for use with the arenas described herein. In FIG. 17, alternative arena enhancement feature 1705 includes placement of a compatible coupler into a surface of an arena (e.g., a floor as shown or into a wall or arena pole or other structure). A single action figure, or group of action figures, engage arena enhancement feature 1705 and provide a gymnastic/dance/athletic performance centered on arena enhancement feature 1705.

Figure 18:
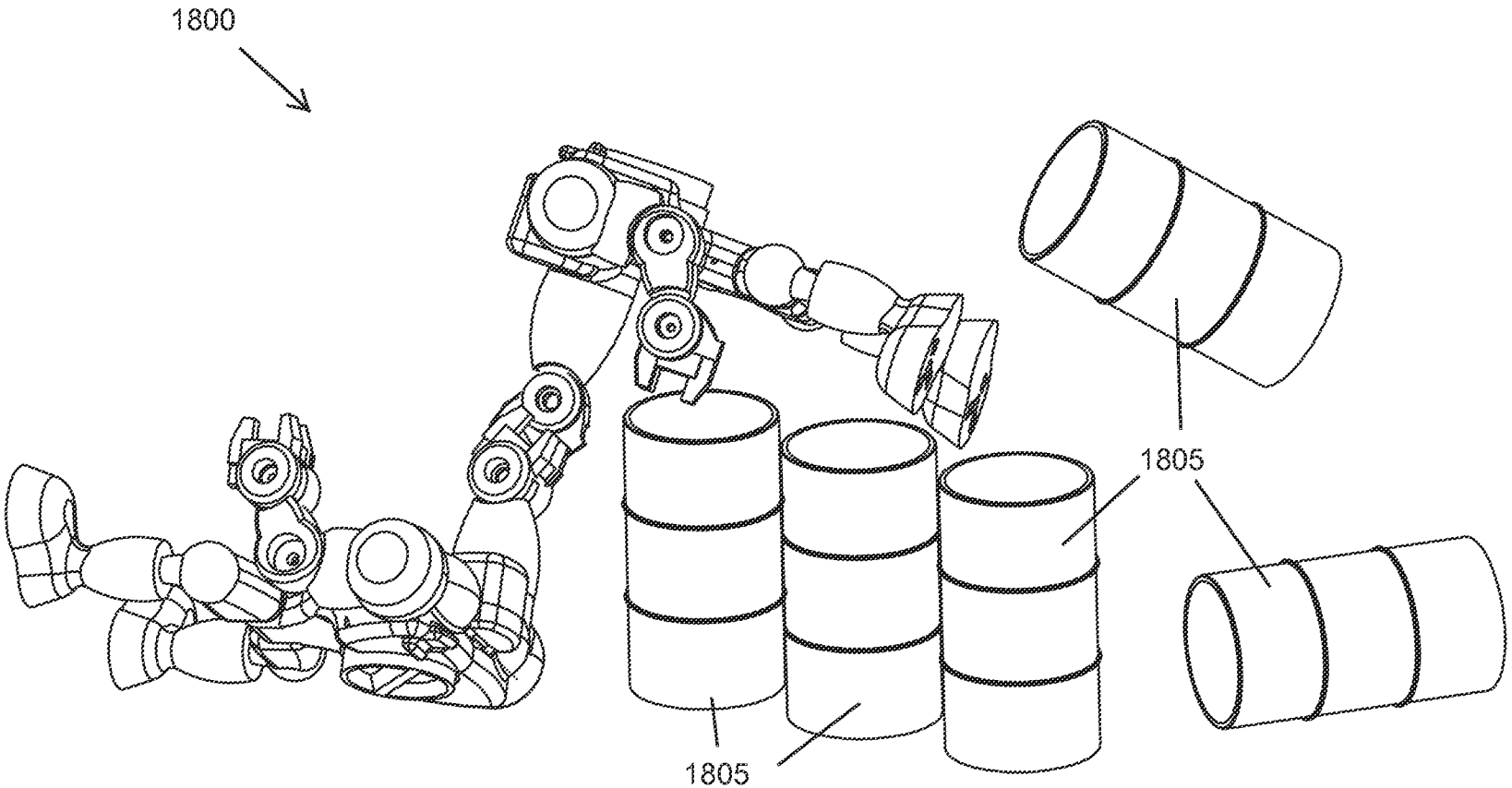
FIG. 18 illustrates environmental elements used to enhance action sequences by engaged action figures.

FIG. 18 illustrates a play environment 1800 including a plurality of environmental elements/props 1805 used to enhance action sequences by engaged action figures. The environmental elements/props 1805 may include simulated bales of hay, barrels, chairs, cones, ladders, other characters/figurines, and the like. Environmental elements/props 1805 may be made of open/closed cell foam or other similarly low density material so as to not interfere with operation or execution of the action sequence as they scatter and fly when contacted, contributing to the simulated action. However in some implementations, environmental elements/props 1805 may be more substantial or secured to a playsurface or other element so as to alter the action sequence.

Figure 19:
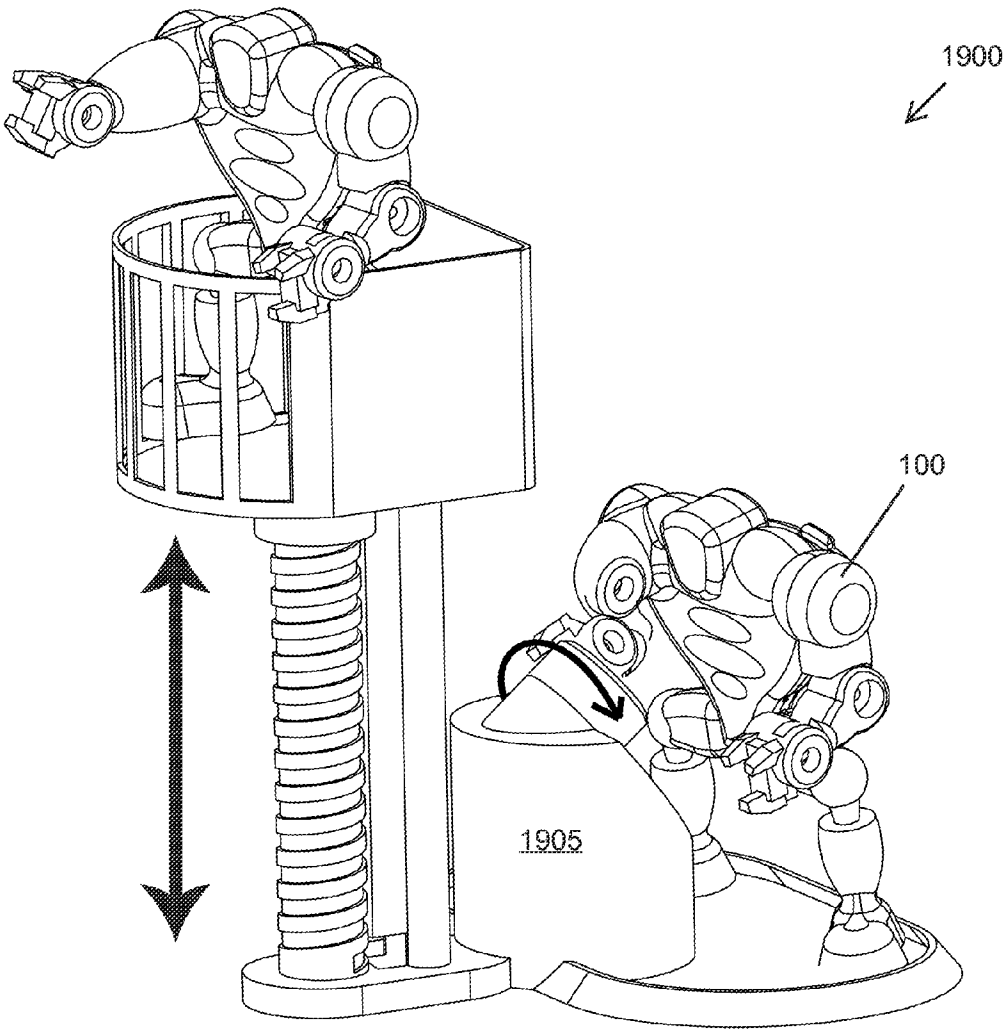
FIG. 19 illustrates enhancement structures that support interaction operation by the power take-off of an action figure.

FIG. 19 illustrates a play environment 1900 including one or more enhancement structures 1905 that support interactive operation by the power take-off of an action figure. As noted above, action figures 100 include a drive limb which can operate as a power take-off. Certain environment enhancements or arena structures may respond to operation of the power take-off. The power take-off engages an actuating element of the enhancement or arena structure, such as using a compatible coupler, and the power take-off is actuated. As shown in FIG. 19, the actuation may raise or lower a platform by driving a lead screw or the like. Other activities may be initiated, controlled, or affected by use of the power take-off in similar fashion.

Figure 20:
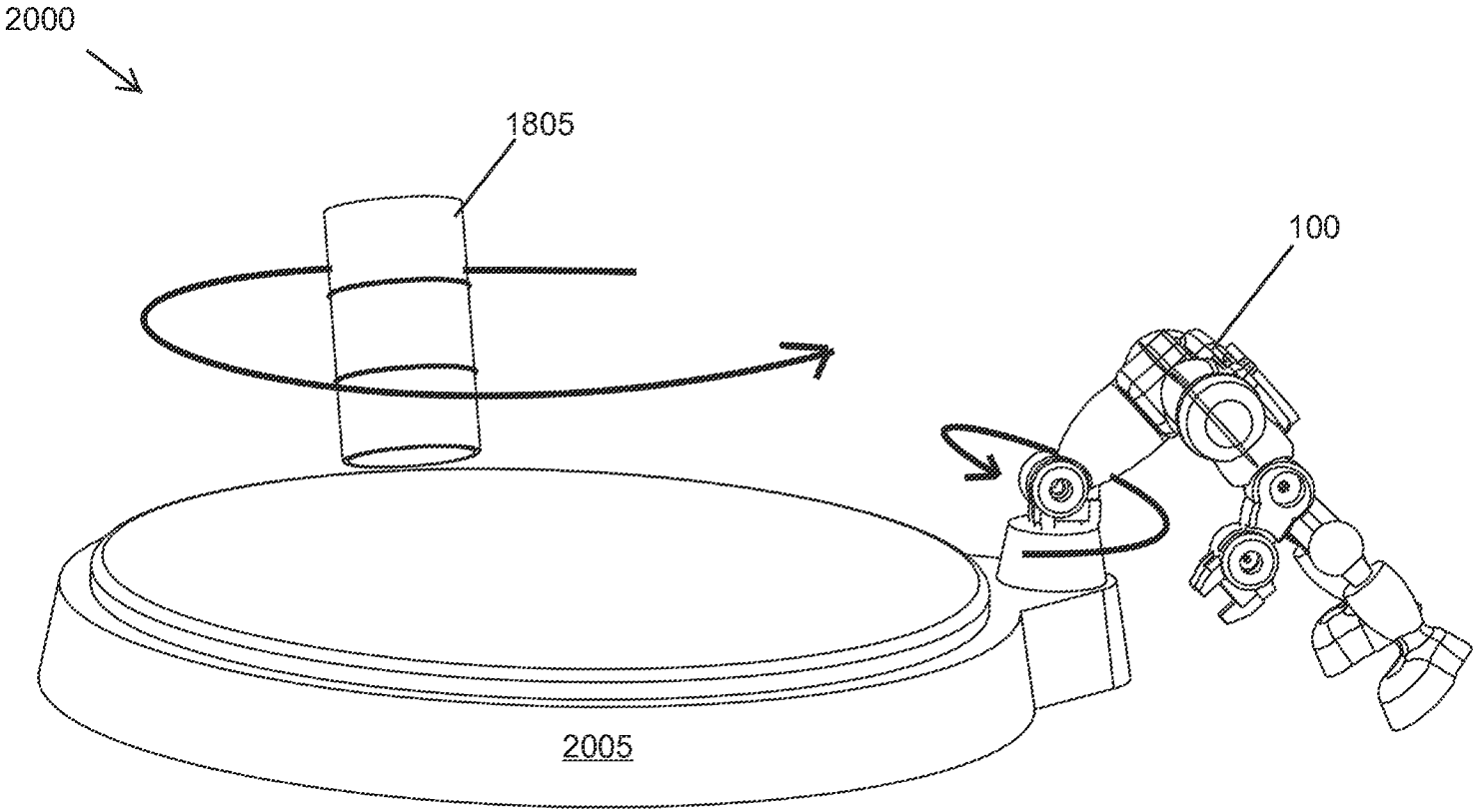
FIG. 20 illustrates an alternative enhancement structures that support interaction operation by the power take-off of an action figure.

FIG. 20 illustrates a play environment 2000 including an alternative enhancement structure 2005 that supports interaction operation by the power take-off of action figure 100. For example, enhancement structure 2005 includes a turntable operated by the power take-off of action figure 100. A plurality of environmental elements/props 1805 may be stacked on the turntable. When action figure 100 is actuated, the power take-off causes the turntable to spin rapidly which cause stacked objects to fall and other objects to be forced off the turntable for additional action driven by action figure 100.

In some embodiments, the motor may include multiple sub-motors or multiple stages for adding additional variability into the skirmish. For example, use of a two-stage motor that periodically reverses rotational direction to alternatively rotate and counter-rotate drive limb 115. It may be the rotational reversal occurs multiple times during the game play, for example rotation directional change 2-6 times. Other variations in drive parameters are possible (for example, periodically changing rotational speed or the like). The changing rotational directions not only may impart improved visuals and improved simulated combat sequences, it can be that the reversed rotation reduces any hang-ups or undesirable restriction in game play.

Preferred embodiments include different components, orientations, and configurations while remaining within the scope of the present invention. The basic configuration may be implemented in a wide range of industrial designs, including well-recognized characters from television, movie, comic book, or other media source. It is an advantage of the preferred embodiments that they may be implemented by simple and relatively inexpensive components, such as using wind-up technology and not requiring stored electrical power (which may optionally be used in lieu of or in support of) energy stored in a spring, elastomeric band, or the like. For example, some embodiments include optional audiovisual elements (e.g., lights and sounds) that may be powered by the motor, or by an auxiliary power system that uses a battery.

As noted above, the universal coupling system provides for easy, quick-connect engagement, and those engagement points may include head, foot, back, and/or chest locations and the like in addition to the appendage engagement points detailed herein. As further noted, in some instances the gameplay may become quite vigorous. Some embodiments include flexible limbs 110 configured with flexible joints or the like to resist damage to an action figure during a skirmish. In response to a shear or bending force that may otherwise result in damage to an element of an action figure, strategic placement of breakaway joints results in separation of the joint or other dissipation of the potentially damaging force to prevent or lessen the damage.

Further variations implemented in some embodiments include use of an umbilical connection system (including extensions to the power take-off 620) for an external drive component and need not be implemented as a limb (i.e., drive limb 115). However implemented, the external drive component may exit and extend in any direction from action figure 100. Some embodiments may include a greater number of sub-elements in the articulating limbs providing for more apparent flexibility and positioning options. It is not required that the motor and internal gear train be completely discrete from body 105. In some implementations, body 105 may be configured to integrate some or all of the internal gear train structure.

The system and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. An apparatus, comprising;

an action figure including a body having a cavity, a motor disposed within said cavity, and a plurality of flexible limbs coupled to said body that may be articulated, and held, into a desired pose wherein said motor is responsive to an actuation to power a rotation of a drive;

an elongate drive element, having a proximal end coupled to said drive and a longitudinal axis extending along a length of said drive element, said drive element configured to rotate around said longitudinal axis in response to said rotation of said drive wherein said drive element is configured as an appendage of said action figure, said appendage including one of an arm, a leg, a hand, a foot, a head, a tail, or portions thereof; and one of a type 1 coupler or a type 2 coupler as a drive element coupler, said type 1 coupler and said type 2 coupler complementary to each other, said drive element coupler disposed at a distal end of said drive element with one of said type 1 coupler or said type 2 coupler as an engagement coupler, said engagement coupler complementary to said drive element coupler and disposed on said action figure;

wherein said drive element coupler is configured for inhibiting rotational slippage relative to said engagement coupler when said drive element rotates longitudinally; and wherein said drive element coupler includes a type 1 male coupler having a plurality of spaced apart longitudinally extending prongs.

2. The apparatus of claim 1 wherein said plurality of spaced apart longitudinally extending prongs are mutually offset in relative x and y dimensions.

3. An apparatus, comprising;

an action figure including a body having a cavity, a motor disposed within said cavity, and a plurality of flexible limbs coupled to said body that may be articulated, and held, into a desired pose wherein said motor is responsive to an actuation to power a rotation of a drive;

an elongate drive element, having a proximal end coupled to said drive and a longitudinal axis extending along a length of said drive element, said drive element configured to rotate around said longitudinal axis in response to said rotation of said drive wherein said drive element is configured as an appendage of said action figure, said appendage including one of an arm, a leg, a hand, a foot, a head, a tail, or portions thereof; and one of a type 1 coupler or a type 2 coupler as a drive element coupler, said type 1 coupler and said type 2 coupler complementary to each other, said drive element coupler disposed at a distal end of said drive element wherein said drive element coupler includes a magnetic element.

4. An apparatus, comprising;

an action figure including a body having a cavity, a motor disposed within said cavity, and a plurality of flexible limbs coupled to said body that may be articulated, and held, into a desired pose wherein said motor is responsive to an actuation to power a rotation of a drive;

an elongate drive element, having a proximal end coupled to said drive and a longitudinal axis extending along a length of said drive element, said drive element configured to rotate around said longitudinal axis in response to said rotation of said drive wherein said drive element is configured as an appendage of said action figure, said appendage including one of an arm, a leg, a hand, a foot, a head, a tail, or portions thereof; and one of a type 1 coupler or a type 2 coupler as a drive element coupler, said type 1 coupler and said type 2 coupler complementary to each other, said drive element coupler disposed at a distal end of said drive element wherein said motor is a spring-driven motor.

5. A method comprising:

a) actuating selectively a spring-driven motor disposed inside an action figure having articulatable limbs coupled to a body, said selective actuation of said motor producing a rotation of a drive element, said drive element supporting a longitudinally rotating drive element coupler as one of a type 1 coupler or a type 2 coupler, said type 1 coupler and said type 2 coupler complementary to each other, said drive element coupler disposed at a distal end of said drive element;

b) transferring said rotation of said drive element to a longitudinal rotation through an appendage of said action figure, said appendage having a proximal end coupled to said body and a distal end coupled to said longitudinally rotating drive element coupler; and c) rotating longitudinally said drive element coupler whenever said motor is actuated.

6. An apparatus, comprising;

a first skirmisher including:

a body having a cavity, a spring-driven motor disposed within said cavity, and a plurality of flexible structures coupled to said body that may be articulated, and held, into a desired pose wherein said motor is responsive to an actuation to power an ungoverned rotation of a drive;

an elongate drive element, having a proximal end coupled to said drive and a longitudinal axis extending along a length of said drive element, said drive element configured to rotate around said longitudinal axis in response to said rotation of said drive; and a drive element coupler rotationally disposed at a distal end of said drive element, said drive element coupler rotating about a pivot axis perpendicular to said longitudinal axis and including means for coupling to a reaction structure without longitudinal slip or appreciable hysteresis.

7. An apparatus, comprising;

a first skirmisher including:

a body having a cavity, a motor disposed within said cavity, and a plurality of flexible limbs coupled to said body that may be articulated, and held, into a desired pose wherein said motor is responsive to an actuation to power an ungoverned rotation of a drive;

an elongate drive element, having a proximal end coupled to said drive and a longitudinal axis extending along a length of said drive element, said drive element configured to rotate around said longitudinal axis in response to said rotation of said drive; and one of a type 1 coupler or a type 2 coupler as a drive element coupler, said type 1 coupler and said type 2 coupler complementary to each other, said drive element coupler rotationally disposed at a distal end of said drive element, said drive element coupler rotating about a pivot axis perpendicular to said longitudinal axis, wherein said body further includes a reaction element having a proximal end coupled to said body and a distal end rotationally coupled to a reaction element coupler, said reaction element coupler one of said type 1 coupler or said type 2 coupler complementary to said drive element coupler.

8. The apparatus of claim 7 including a second skirmisher configured as said first skirmisher wherein said drive element coupler of said first skirmisher is coupled to said reaction element coupler of said second skirmisher.

* * * * *